US006439004B1

(12) United States Patent
Chang

(10) Patent No.: US 6,439,004 B1
(45) Date of Patent: Aug. 27, 2002

(54) FABRIC TENSION CONTROL DEVICE FOR A DYEING MACHINE

(76) Inventor: Chi-Lung Chang, PO Box 82-144, Taipei (TW)

( * ) Notice: Subject to any disclaimer, the term of this patent is extended or adjusted under 35 U.S.C. 154(b) by 70 days.

(21) Appl. No.: 09/664,710

(22) Filed: Sep. 19, 2000

(51) Int. Cl.[7] ..... D06B 23/06
(52) U.S. Cl. ..... 68/212; 68/157
(58) Field of Search ..... 68/212, 175, 180, 68/157, 160, 161, 177

(56) References Cited

U.S. PATENT DOCUMENTS 2,005,942 A * 6/1935 Lake
3,102,771 A * 9/1963 Neale
3,479,846 A * 11/1969 Walsom
3,483,720 A * 12/1969 Inada
3,548,616 A * 12/1970 Catoll et al.
3,604,224 A * 9/1971 Beasly
3,905,059 A * 9/1975 Stanway
4,558,575 A * 12/1985 Serracant et al.
5,005,270 A * 4/1991 Childers
5,172,444 A * 12/1992 Peant
5,197,306 A * 3/1993 Yamakita
6,129,767 A * 10/2000 Hong

* cited by examiner

*Primary Examiner*—Frankie L. Stinson
(74) *Attorney, Agent, or Firm*—Leong C. Lei

(57) ABSTRACT

A fabric tension control device includes two holder plates fixedly mounted inside a dyeing machine at two opposite lateral sides, and an elongated fabric guide connected between the holder plate and adapted to guide pieces of fabric in the dyeing machine, the holder plates each having a receiving portion adapted to hold the elongated fabric guide in one of a series of angular positions, the elongated fabric guide having a plurality of rod members and a plurality of rectangular open frames alternatively connected in series and adapted to guide a respective piece of fabric in the dyeing machine, pairs of revolving cylinders respectively disposed at two opposite long sides of each rectangular open frame and adapted to guide movement of pieces of fabrics in the dyeing machine, and two polygonal end blocks disposed at two distal ends of the series of rod members and rectangular frames and respectively coupled to the receiving portions of the holder plates in one of a series of angular positions.

4 Claims, 3 Drawing Sheets

FABRIC TENSION CONTROL DEVICE FOR A DYEING MACHINE

BACKGROUND OF THE INVENTION

The present invention relates to dyeing machines and, more specifically, to a fabric tension control device for a dyeing machine, which can be conveniently adjusted to one of a series of angular positions to change the tension of dyeing pieces of fabric.

In a dyeing machine, pieces of fabric are continuously moved through respective dyeing vats, and dyeing liquor is driven out of spray nozzles toward fabrics, causing pieces of fabric to be well dyed in the respective dyeing vats. In order to keep smooth circulation of pieces of fabric through the respective dyeing vats, fabric guide rings are commonly used and fixedly installed in the dyeing machine to guide respective pieces of fabric. In order to achieve a satisfactory dyeing effect, pieces of fabric of different thickness require different tension when passing through the respective dyeing vats. However, because the fabric guide rings have a fixed size, they cannot fit different fabrics having different thickness.

SUMMARY OF THE INVENTION

It is the main object of the present invention to provide a fabric guide control for a dyeing machine, which can conveniently be adjusted to change the tension of dyeing pieces of fabric subject to their quality. According to one aspect of the present invention, two holder plates are fixedly mounted in the dyeing machine at two opposite sides, and an elongated fabric guide is coupled between the holder plates and set in one of a series of angular positions for guiding and controlling the tension of pieces of fabric. According to another aspect of the present invention, the elongated fabric guide comprises two polygonal end blocks adapted for coupling to the holder plates, enabling the elongated fabric guide to be set in one of a series of angular positions. According to still another aspect of the present invention, the elongated fabric guide comprises a plurality of rectangular open frames connected in series and adapted to guide dyeing pieces of fabric, each rectangular open frame being equipped with two revolving cylinders at two opposite long sides to facilitate forward movement of dyeing pieces of fabric.

DETAILED DESCRIPTION OF THE PREFERRED EMBODIMENT

Figure 1:
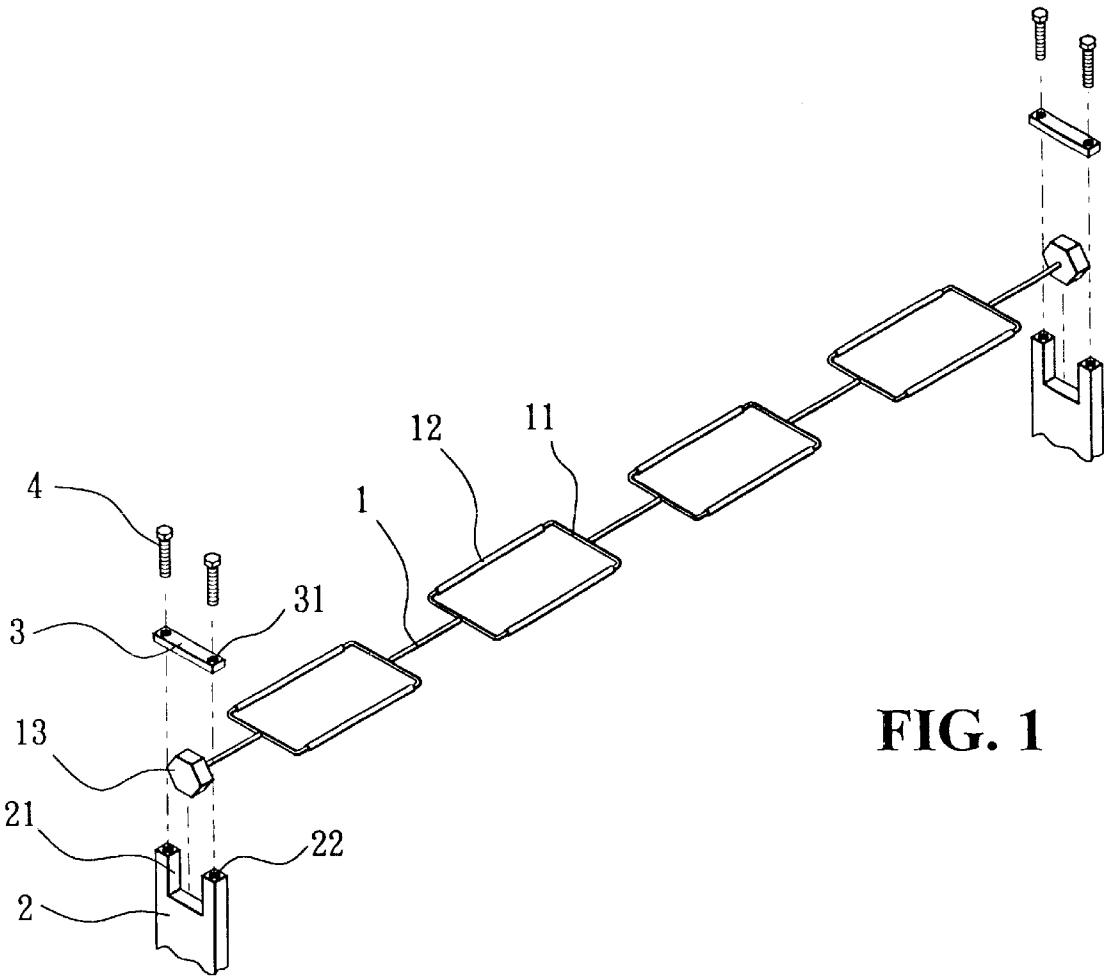
FIG. 1 is an exploded view of a tension control device according to the present invention.
Figure 2:
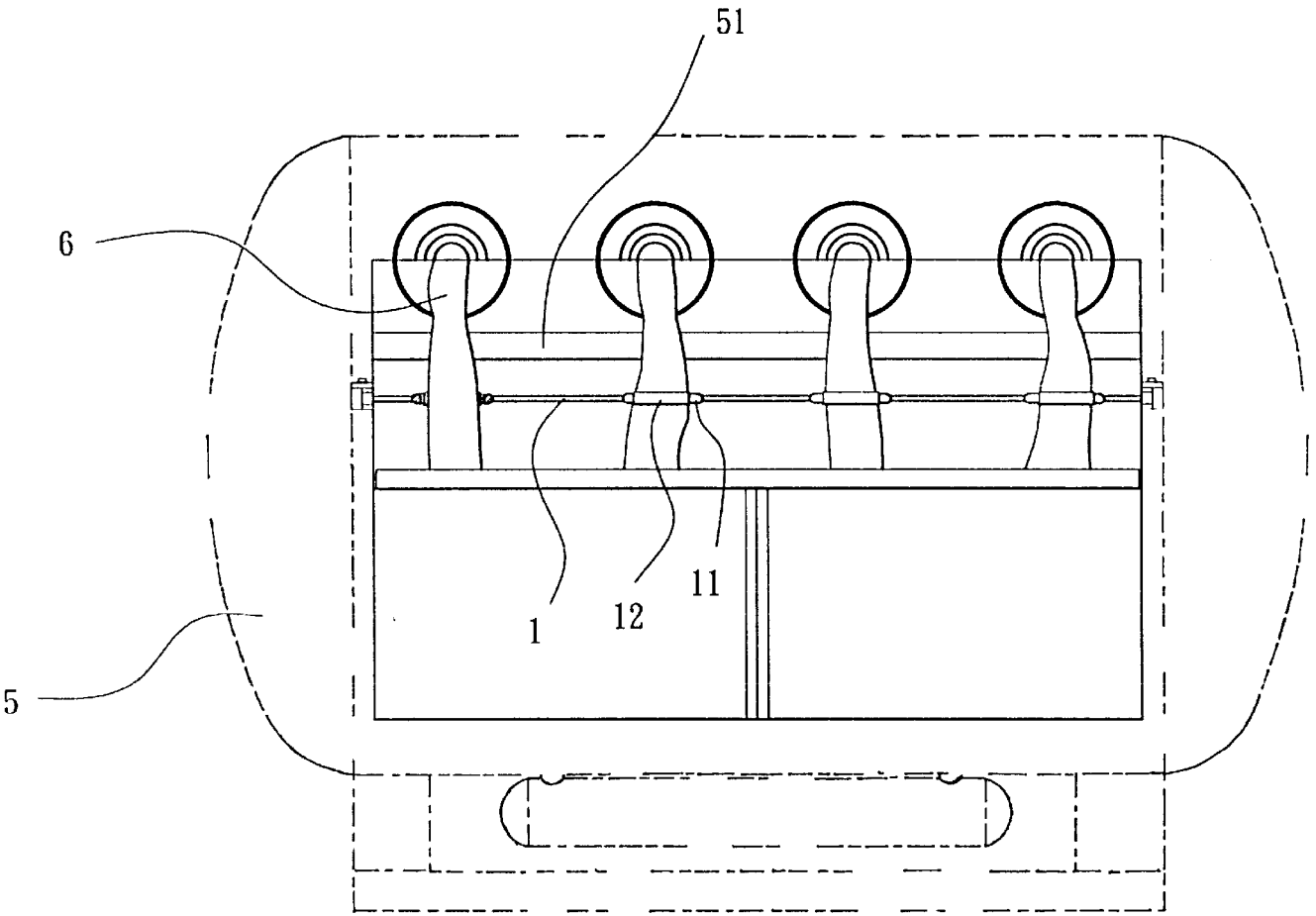
FIG. 2 is a sectional view showing the tension control device installed in a dyeing machine and set in horizontal.

Referring FIGS. 1 and 2, a fabric tension control device in accordance with the present invention comprises two holder plates 2 bilaterally fastened to the inside of the dyeing machine 5, an elongated fabric guide connected between the holder plates 2, and two cover plates 3 respectively fastened to the holder plates 2 to secure the elongated fabric guide 1 in position. The aforesaid fabric guide comprises a plurality of rod members 1 and a plurality of rectangular open frames 11 alternatively connected in series, and two polygonal positioning blocks, for example, hexagonal positioning blocks 13 disposed at two distal ends of the series of rod members 1 and rectangular open frame 11 and respectively coupled to the holder plates 2. The rectangular open frames 11 each comprise two cylinders 12 longitudinally revolvably arranged at two opposite long sides thereof. The holder frames 2 each comprise a receiving portion 21 adapted to receive the hexagonal positioning blocks 13, and two vertical screw holes 22 disposed at two sides of the receiving portion 21. The cover plates 3 each comprise two mounting holes 31 respectively fastened to the screw holes 22 of the holder plates 2. After the hexagonal positioning blocks 13 have been respectively engaged into the receiving portion 21 of each holder plate 2, screws 4 are respectively mounted in the mounting holes 31 of the cover plates 3 and threaded into the screw holes 22 of the holder plates 2 to fix the cover plates 2 to the holder plates 2 respectively, knowing the hexagonal positioning blocks 13 positively secured to the holder plates 2 in position. Further, the receiving portion 21 of each holder plate 2 has a flat bottom side adapted to support one peripheral side of the corresponding hexagonal positioning block 13 positively in position.

Figure 3:
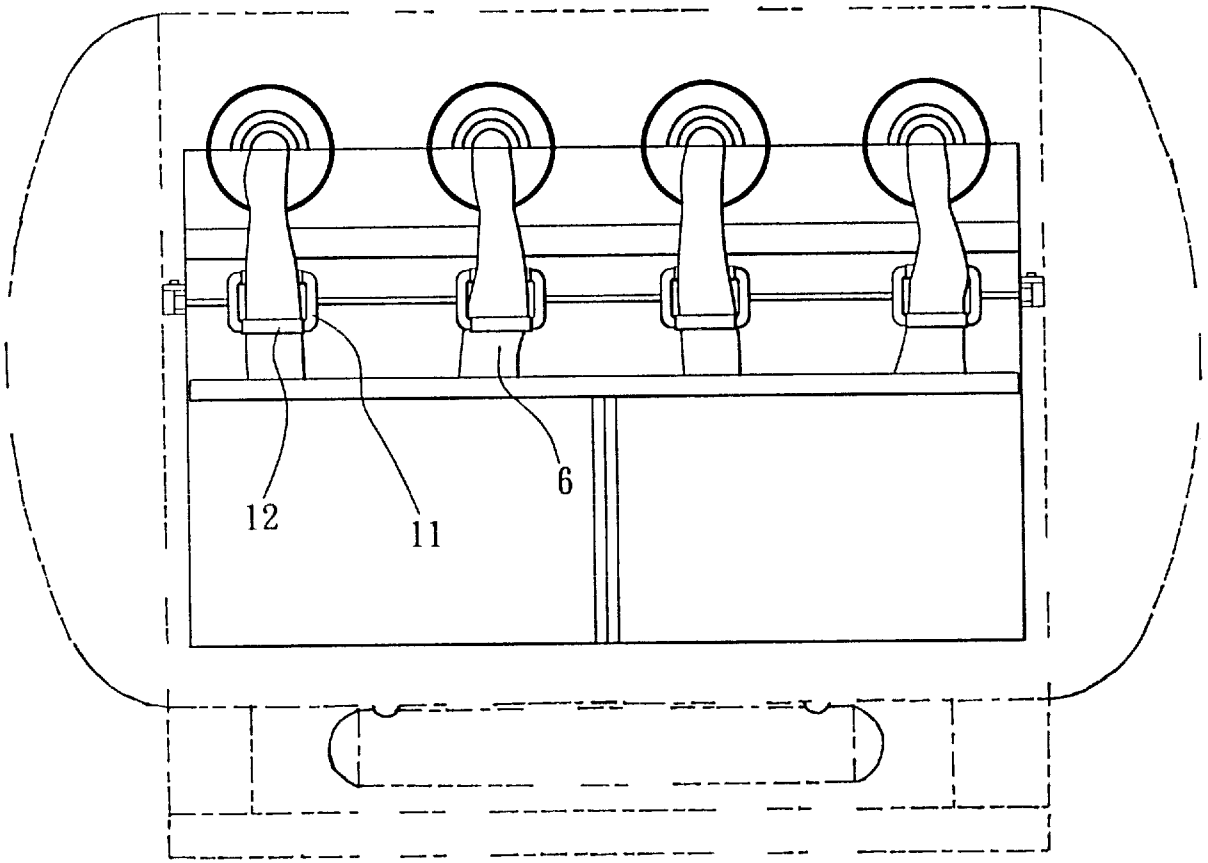
FIG. 3 is similar to FIG. 2 but showing the angular position of the tension control device adjusted.

Referring to FIG. 3 and FIG. 2 again, after the screws 4 had been loosened, the angular position of the rectangular open frames 11 can be adjusted relative to the holder plates 2. FIG. 2 shows the fabric guide adjusted to the horizontal position, and pieces of fabric 6 are delivered forwards over a guide roll 51 and then passed through the rectangular open frames 11. In this horizontal position, the rectangular open frames 11 give little pressure to the pieces of fabric 6. During forward movement of the pieces of fabric 6, the cylinders 12 of the rectangular open frames 11 are rotated by the moving pieces of fabric 6. Therefore, less friction resistance exists between the pieces of fabric 6 and the rectangular open frames 11. FIG. 3 shows the fabric guide adjusted from the horizontal position to a tilted position. In this tilted position, the rectangular open frames 11 give a pressure to the pieces of fabric 6. Therefore, by means of adjusting the angular position of the fabric guide 1, the tension of the pieces of fabric 6 is relatively changed.

It is to be understood that the drawings are designed for purposes of illustration only, and are not intended for use as a definition of limits and scope of the invention disclosed.

What the invention claimed is:

1. A fabric tension control device comprising two holder plates fixedly mounted inside a dyeing machine at two opposite lateral sides, and an elongated fabric guide connected between said holder plate and adapted to guide pieces of fabric in the dyeing machine, said holder plates each comprising a receiving portion adapted to hold said elongated fabric guide in one of a series of angular positions, said elongated fabric guide comprising a plurality of rod members and a plurality of rectangular open frames alternatively connected in series, and two end blocks disposed at two distal ends of the series of rod members and rectangular open frames and respectively coupled to the receiving portions of said holder plates in one of a series of angular positions.

2. The fabric tension control device of claim 1 wherein said end blocks are polygonal blocks.

3. The fabric tension control device of claim 2 further comprising two cover plates respectively covered on the receiving portions of said holder plates to hold down the end blocks of said elongated fabric guide in position.

4. The fabric tension control device of claim 1 wherein said rectangular open frames each have two opposite long sides mounted with a respective revolving cylinder adapted to guide movement of pieces of fabrics through said rectangular open frames.

* * * * *